US006750875B1

(12) United States Patent
Keely, Jr. et al.

(10) Patent No.: US 6,750,875 B1
(45) Date of Patent: Jun. 15, 2004

(54) COMPRESSION OF IMAGE DATA ASSOCIATED WITH TWO-DIMENSIONAL ARRAYS OF PIXEL SUB-COMPONENTS

(75) Inventors: Leroy B. Keely, Jr., Portola Valley, CA (US); William Hill, Carnation, WA (US); Geraldine Wade, Redmond, WA (US); Gregory C. Hitchcock, Woodinville, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/495,771

(22) Filed: Feb. 1, 2000

Related U.S. Application Data

(60) Provisional application No. 60/118,048, filed on Feb. 1, 1999.

(51) Int. Cl.[7] ..... G09G 3/36; G09G 5/02

(52) U.S. Cl. ..... 345/613; 345/589; 345/55; 345/90; 345/690

(58) Field of Search ..... 345/589, 591, 345/601, 611, 613–614, 690, 467–469.1, 470–472, 947, 204, 72, 205, 83, 694, 87, 698, 88, 22, 55, 593, 597, 89–90, 618, 63, 695; 382/203, 254, 256, 299, 163, 162, 167, 275

(56) References Cited

U.S. PATENT DOCUMENTS

| | | | | |
|---|---|---|---|---|
| 4,136,359 | A | 1/1979 | Wozniak | 358/17 |
| 4,217,604 | A | 8/1980 | Wozniak | 358/16 |
| 4,278,972 | A | 7/1981 | Wozniak | 340/703 |
| 5,057,739 | A | 10/1991 | Shimada et al. | 313/477 R |
| 5,113,274 | A | 5/1992 | Takahashi et al. | 359/66 |
| 5,122,783 | A | 6/1992 | Bassetti, Jr. | 340/701 |

(List continued on next page.)

FOREIGN PATENT DOCUMENTS

| | | | |
|---|---|---|---|
| EP | 0346621 A2 | 12/1989 | H04N/9/12 |
| EP | 0435391 A2 | 7/1991 | G09G/3/20 |
| EP | 0810578 A1 | 12/1997 | G09G/3/36 |
| EP | 0899604 A2 | 3/1999 | G02F/1/1335 |
| JP | 09051548 | 2/1997 | H04N/9/64 |

OTHER PUBLICATIONS

Abram, G. et al. "Efficient Alias–free Rendering using Bit–masks and Look–Up Tables" *San Francisco,* vol. 19, No. 3, 1985 (pp. 53–59).

(List continued on next page.)

*Primary Examiner*—Matthew C. Bella
*Assistant Examiner*—Wesner Sajous
(74) *Attorney, Agent, or Firm*—Workman Nydegger

(57) ABSTRACT

Display devices and image rendering processes increase the resolution of displayed images in the horizontal and vertical dimensions. The increased resolution is obtained on LCD display devices or other display devices having separately controllable pixel sub-components. Assuming the display devices have vertical stripes, much of the increased resolution in the horizontal direction is obtained by mapping spatially different sets of one or more samples to the individual pixel sub-components. In this way, the pixel sub-components are treated as separate luminous intensity sources. The improved resolution in the vertical dimension is achieved by increasing the pixel sub-component density in the vertical dimension. To accommodate the increased number of pixel sub-components, image data compression can be performed if bandwidth limitations are present. The image data compression involves controlling sets of vertically adjacent pixels using red, green, and blue luminous intensity values and a bias value. The red, green, and blue luminous intensity values control the overall luminance of the sets of red, green, and blue pixel sub-components, while the bias value indicates if, and to what extent, the luminance is to be shifted to a particular pixel in the set of pixels.

17 Claims, 7 Drawing Sheets

U.S. PATENT DOCUMENTS

| | | | | | |
|---|---|---|---|---|---|
| 5,254,982 | A | | 10/1993 | Feigenblatt et al. | 345/148 |
| 5,298,915 | A | | 3/1994 | Bassetti, Jr. | 345/149 |
| 5,334,996 | A | | 8/1994 | Tanigaki et al. | 345/152 |
| 5,341,153 | A | * | 8/1994 | Benzschawel et al. | 345/589 |
| 5,349,451 | A | | 9/1994 | Dethardt | 358/518 |
| 5,467,102 | A | | 11/1995 | Kuno et al. | 345/1 |
| 5,543,819 | A | | 8/1996 | Farwell et al. | 345/150 |
| 5,548,305 | A | | 8/1996 | Rupel | 345/150 |
| 5,555,360 | A | | 9/1996 | Kumazaki et al. | 395/143 |
| 5,633,654 | A | | 5/1997 | Kennedy, Jr. et al. | 345/114 |
| 5,689,283 | A | | 11/1997 | Shirochi | 345/132 |
| 5,767,837 | A | | 6/1998 | Hara | 345/152 |
| 5,821,913 | A | | 10/1998 | Mamiya | 345/88 |
| 5,847,698 | A | | 12/1998 | Reavey et al. | 345/173 |
| 5,894,300 | A | | 4/1999 | Takizawa | 345/115 |
| 5,949,643 | A | | 9/1999 | Batio | 361/681 |
| 5,963,185 | A | | 10/1999 | Havel | 345/83 |
| 6,188,385 | B1 | * | 2/2001 | Hill et al. | 345/613 |
| 6,219,025 | B1 | * | 4/2001 | Hill et al. | 345/589 |
| 6,225,973 | B1 | * | 5/2001 | Hill et al. | 345/589 |
| 6,239,783 | B1 | * | 5/2001 | Hill et al. | 345/694 |
| 6,243,070 | B1 | * | 6/2001 | Hill et al. | 345/613 |
| 6,278,434 | B1 | * | 8/2001 | Hill et al. | 345/660 |
| 6,282,327 | B1 | * | 8/2001 | Betrisey et al. | 382/299 |
| 6,307,566 | B1 | * | 10/2001 | Hill et al. | 345/613 |
| 6,339,426 | B1 | * | 1/2002 | Lui et al. | 345/467 |
| 6,342,890 | B1 | * | 1/2002 | Shetter | 345/467 |
| 6,342,896 | B1 | * | 1/2002 | Shetter et al. | 345/589 |
| 6,356,278 | B1 | * | 3/2002 | Stam et al. | 345/611 |
| 6,360,023 | B1 | * | 3/2002 | Betrisey et al. | 382/260 |
| 6,377,262 | B1 | * | 4/2002 | Hitchcock et al. | 345/467 |
| 6,393,145 | B2 | * | 5/2002 | Betrisey et al. | 382/162 |
| 6,396,505 | B1 | * | 5/2002 | Lui et al. | 345/613 |
| 6,421,054 | B1 | * | 7/2002 | Hill et al. | 345/469 |

OTHER PUBLICATIONS

Ahumada, A.J. et al. "43.1: A Simple Vision Model for Inhomogeneous Image–Quality Assessment" *1998 SID*.

Barbier, B. "25.1: Multi–Scale Filtering for Image Quality on LCD Matrix Displays" *SID 96 Digest*.

Barten, P.G.J. "P–8: Effect of Gamma on Subjective Image Quality" *SID 96 Digest*.

Beck, D.R. "Motion Dithering for Increasing Perceived Image Quality for Low–Resolution Displays" *1998 SID*.

Bedford–Roberts, J. et al. "10.4: Testing the Value of Gray–Scaling for Images of Handwriting" *SID 95 Digest*, pp. 125–128.

Chen, L.M. et al. "Visual Resolution Limits for Color Matrix Displays" *Displays—Technology and Applications,* vol. 13, No. 4, 1992, pp. 179–186.

Cordonnier, V. "Antialiasing Characters by Pattern Recognition" *Proceedings of the S.I.D.* vol. 30, No. 1, 1989, pp. 23–28.

Cowan, W. "Chapter 27, Displays for Vision Research" *Handbook of Optics, Fundamentals, Tecniques & Design,* Second Edition, vol. 1, pp. 27.1–27.44.

Crow, F.C. "The Use of Grey Scale for Improved Raster Display of Vectors and Characters" *Computer Graphics,* vol. 12, No. 3, Aug. 1978, pp. 1–5.

Feigenblatt, R.I., "Full–color Imaging on amplitude–quantized color mosaic displays" *Digital Image Processing Applications SPIE* vol. 1075 (1989) pp. 199–205.

Gille, J. et al. "Grayscale/Resolution Tradeoff for text: Model Predictions" *Final Report,* Oct 1992–Mar. 1995.

Gould, J.D. et al. "Reading From CRT Displays Can Be as Fast as Reading From Paper" *Human Factors,* vol. 29, No. 5, pp. 497–517, Oct. 1987.

Gupta, S. et al. "Anti–Aliasing Characters Displayed by Text Terminals" *IBM Technical Disclosure Bulletin,* May 1983 pp. 6434–6436.

Hara, Z. et al. "Picture Quality of Different Pixel Arrangements for Large–Sized Matrix Displays" *Electronics and Communications in Japan,* Part 2, vol. 77, No. 7, 1974, ppl. 105–120.

Kajiya, J. et al. "Filtering High Quality Text For Display on Raster Scan Devices" *Computer Graphics,* vol. 15, No. 3, Aug. 1981, pp. 7–15.

Kato, Y. et al. "13:2 A Fourier Analysis of CRT Displays Considering the Mask Structure, Beam Spot Size, and Scan Pattern" (c) *1998 SID*.

Krantz, J. et al. "Color Matrix Display Image Quality: The Effects of Luminance and Spatial Sampling" *SID 90 Digest*, pp. 29–32.

Kubala, K. et al. "27:4: Investigation Into Variable Addressability Image Sensors and Display Systems" *1998 SID*.

Mitchell, D.P. "Generating Antialiased Images at Low Sampling Densities" *Computer Graphics,* vol. 21, No. 4, Jul. 1987, pp. 65–69.

Mitchell, D.P. et al., "Reconstruction Filters in Computer Graphics", *Compute Graphics,* vol. 22, No. 4, Aug. 1988, pp. 221–228.

Morris R.A., et al. "Legibility of Condensed Perceptually–tuned Grayscale Fonts" *Electronic Publishing, Artistic Imaging, and Digital Typography,* Sevent International Conference on Electronic Publishing, Mar. 30–Apr. 3, 1998, pp. 281–293.

Murch, G. et al. "7.1: Resolution and Addressability: How Much is Enough?" *SID 85 Digest*, pp. 101–103.

Naiman, A., "Some New Ingredients for the Cookbook Approach to Anti–Aliased Text" *Proceedings Graphics Interface 81,* Ottawa, Ontariao, May 28–Jun. 1, 1984, pp. 99–108.

Naiman, A, et al. "Rectangular Convolution for Fast Filtering of Characters" *Computer Graphics,* vol. 21, No. 4, Jul. 1987, pp. 233–242.

Naiman, A.C. "10:1 The Visibility of Higher–Level Jags" *SID 95 Digest* pp. 113–116.

Peli, E. "35.4: Luminance and Spatial–Frequency Interaction in the Perception of Contrast", *SID 96 Digest*.

Pringle, A., "Aspects of Quality in the Design and Production of Text", *Association of Computer Machinery* 1979, pp. 63–70.

Rohellec, J. Le et al. "35.2: LCD Legibility Under Different Lighting Conditions as a Function of Character Size and Contrast" *SID 96 Digest*.

Schmandt, C. "Soft Typography Information Processing 80", *Proceedings of the IFIP Congress* 1980, pp. 1027–1031.

Sheedy, J.E. et al. "Reading Performance and Visual Comfort with Scale to Grey Compared with Black–and–White Scanned Print" *Displays,* vol. 15, No. 1, 1994, pp. 27–30.

Sluyterman, A.A.S. "13:3 A Theoretical Analysis and Empirical Evaluation of the Effects of CRT Mask Structure on Character Readability" (*c*) *1998 SID*.

Tung. C., "Resolution Enhancement Technology in Hewlett–Packard LaserJet Printers" *Proceedings of the SPIE—The International Society for Optical Engineering,* vol. 1912, pp. 440–448.

Warnock, J.E. "The Display of Characters Using Gray Level Sample Arrays", *Association of Computer Machinery,* 1980, pp. 302–307.
Whitted, T. "Anti–Aliased Line Drawing Using Brush Extrusion" *Computer Graphics,* vol. 17, No. 3, Jul. 1983, pp. 151,156.
Yu, S., et al. "43:3 How Fill Factor Affects Display Image Quality" (c) *1998 SID*.
"Cutting Edge Display Technology—The Diamond Vision Difference" www.amasis.com/diamondvision/technical.html, Jan. 12, 1999.
"Exploring the Effect of Layout on Reading from Screen" http://fontweb/internal/repository/research/explor.asp?RES=ultra, 10 pages, Jun. 3, 1998.
"How Does Hinting Help?" http://www.microsoft.com/typography/hinting/how.htm/fname=%20&fsize, Jun. 30, 1997.
"Legibility on screen: A report on research into line length, document height and number of columns" http://fontweb/internal/repository/research/scrnlegi.asp?RES=ultra Jun. 3, 1998.
"The Effect of Line Lenghth and Method of Movement on reading from screen" http://fontweb/internal/repository/research/linelength.asp?RES=ultra, 20 pages, Jun. 3, 1998.
"The Legibility of Screen Formats: Are Three Columns Better Than One?" http://fontweb/internal/repository/research/scrnformat.asp?RES=ultra, 16 pages, Jun. 3, 1998.
"The Raster Tragedy at Low Resolution" http://www.microsoft.com/typography/tools/trtalr.htm?fname=%20&fsize.
"The TrueType Rasterizer" http://www.microsoft.com/typography/what/raster.htm?fname=%20&fsize, Jun. 30, 1997.
"TrueType fundamentals" http://www.microsoft.com/OTSPEC/TTCHO1.htm?fname=%20&fsize= Nov. 16, 1997.
"True Type Hinting" http://www.microsoft.com/typography/hinting/hinting.htm Jun. 30, 1997.
"Typographic Research" http://fontweb/internal/repository/research/research2.asp?RES=ultra Jun. 3, 1998.

* cited by examiner

400

| | | |
|---|---|---|
| 402 R1 | 404 G1 | 406 B1 |
| 408 R2 | 410 G2 | 412 B2 |
| 414 R3 | 414 G3 | 416 B3 |

FIG. 5A

450

| | C1 | | | C2 | | | C3 | | | C4 | | |
|---|---|---|---|---|---|---|---|---|---|---|---|---|
| R1 | R1 | G1 | B1 | R1 | G1 | B1 | R1 | G1 | B1 | R1 | G1 | B1 |
| | R2 | G2 | B2 | R2 | G2 | B2 | R2 | G2 | B2 | R2 | G2 | B2 |
| | R3 | G3 | B3 | R3 | G3 | B3 | R3 | G3 | B3 | R3 | G3 | B3 |
| R2 | R1 | G1 | B1 | R1 | G1 | B1 | R1 | G1 | B1 | R1 | G1 | B1 |
| | R2 | G2 | B2 | R2 | G2 | B2 | R2 | G2 | B2 | R2 | G2 | B2 |
| | R3 | G3 | B3 | R3 | G3 | B3 | R3 | G3 | B3 | R3 | G3 | B3 |
| R3 | R1 | G1 | B1 | R1 | G1 | B1 | R1 | G1 | B1 | R1 | G1 | B1 |
| | R2 | G2 | B2 | R2 | G2 | B2 | R2 | G2 | B2 | R2 | G2 | B2 |
| | R3 | G3 | B3 | R3 | G3 | B3 | R3 | G3 | B3 | R3 | G3 | B3 |

FIG. 5B

COMPRESSION OF IMAGE DATA ASSOCIATED WITH TWO-DIMENSIONAL ARRAYS OF PIXEL SUB-COMPONENTS

RELATED APPLICATION

This application claims the benefit of U.S. Provisional Patent Application Serial No. 60/118,048, filed Feb. 1, 1999, entitled "Methods and Apparatus for Improving the Resolution of Display Devices and Displayed Images," which is incorporated herein by reference.

BACKGROUND OF THE INVENTION

1. The Field of the Invention

The present invention relates to methods and apparatus for displaying images, and more particularly, to methods and apparatus for increasing the perceived resolution of the displayed images and compressing image data to enable control signals to be efficiently transmitted to display devices.

2. The Prior State of the Art

Color display devices have become the principal display devices of choice for most computer users. The display of color on a monitor is normally achieved by operating the display device to emit light, typically a combination of red, green, and blue light, which results in one or more colors being perceived by a human viewer.

In cathode ray tube (CRT) display devices, the different colors of light are generated by phosphor coatings that may be applied as dots in a sequence on the screen of the CRT. A different phosphor coating is normally used to generate each of the red, green, and blue colors, resulting in repeating patterns of phosphor dots. When excited by a beam of electrons, the phosphor dots generate the colors red, green and blue.

The term pixel is commonly used to refer to one spot in, for example, a rectangular grid of thousands of such spots. Many computer applications and other types of applications assume that each pixel corresponds to a square portion of a display screen. Pixels are individually used by a computer to form an image on the display device. For a color CRT, where a single triad of red, green and blue phosphor dots cannot be addressed, the smallest possible pixel size will depend on the focus, alignment and bandwidth of the electron guns used to excite the phosphors. The light emitted from one or more triads of red, green and blue phosphor dots, in various arrangements known for CRT displays, tends to blend together giving, at a distance, the appearance of a single colored light source representing a pixel.

Liquid crystal displays (LCDs) and other flat panel display devices are commonly used in portable computer devices in place of CRTs. This is because flat panel displays tend to be small and lightweight in comparison to CRT displays. In addition, flat panel displays generally consume less power than comparably sized CRT displays, making them better suited for battery powered applications. As the quality of flat panel color display devices increases and their cost decreases, flat panel displays continue to replace CRT displays in desktop applications. Accordingly, flat panel displays, and LCDs in particular, are becoming ever more common.

Color LCD displays are exemplary of display devices that utilize multiple separately addressable and controllable elements, referred to herein as "pixel sub-components," to represent each pixel of an image being displayed. In many known LCD displays, each pixel is a single square element that includes non-square red, green and blue (RGB) pixel sub-components. When combined, the RGB pixel sub-components form the square pixel.

FIG. 1 illustrates a portion of a known LCD device 100. The illustrated LCD device 100 includes four columns (C1–C4) and three rows (R1–R3) of pixels, each of which has a separate red pixel sub-component 102, green pixel sub-component 104 and blue pixel sub-component 106. Each of the three pixel sub-components 102, 104, 106 is three times taller than it is wide. As a result of their aspect ratios of 3:1, the RGB pixel sub-components 102, 104, 106 produce a square pixel. The RGB pixel sub-components 102, 104, 106 are arranged to form stripes along LCD device. The RGB stripes normally run the entire length of the display in one direction. Common LCD devices used for computer applications are wider than they are tall and tend to have RGB stripes running in the vertical direction. For convenience, the invention is described herein primarily in the context of LCD devices having vertical stripes, although the principles of the invention apply to display devices having other pixel sub-component configurations.

In color displays, the intensity of the emitted red, green and blue light produced by the corresponding pixel sub-components 102, 104, 106 can be varied to generate the appearance of almost any desired color pixel. Emitting no light from the pixel sub-components 102, 104, 106 produces a black pixel, whereas emitting all three colors at 100 percent intensity results in a white pixel.

While conventional displays have proved satisfactory for many applications, there is a need for resolution improvement. The resolution of flat panel display devices, which is considerably lower than the resolution achieved by print media, makes it difficult to display high quality Latin-based and similar alphanumeric characters at small text sizes commonly used for reading. The problem of low resolution is even more pronounced when complex script languages, such as Japanese, Chinese, Korean, and the Indic languages, are displayed. Ideographic languages, such as Japanese, use large numbers of Kanji characters or other characters that often rely as heavily on vertical resolution as horizontal resolution.

The most complex Kanji character has nine horizontal lines, thus requiring 17 pixels to represent the lines and the spaces between them. At current display resolutions near 100 dots per inch, a true representation is not feasible at font sizes smaller than about 14 point type ($^{14}/_{72}$ of an inch). At 100 dots per inch, display devices simply do not have enough dots to depict complex Kanji characters at text sizes that would be preferred for comfortable reading.

Japanese books are commonly printed in 9, 10 and 11-point type, which are similar to those used in Western books. This is a desirable size for reading based on human physiology. Manga comic books, hugely popular in Japan, use even smaller type sizes. Further complicating matters is the fact that small frutigana characters used to provide Japanese with pronunciation guidance for less-common Kanji characters are typically displayed using 3 or 4 point type. Representing characters at these sizes on computer screens, particularly LCDs, presents huge challenges.

One known technique to addressing the unavailability of screen pixels to represent the full strokes of complex characters has been to use hand-tuned bitmaps at small sizes. Unfortunately, these hand-tuned bitmaps are, at best, crude representations of characters that cannot be drawn accurately at the desired display sizes given the resolution of conventional displays. In such implementations, some strokes in the true character outlines have to be run together or completely eliminated. Decisions as to which strokes can be edited in such a manner require extensive knowledge of the specific language and involve a great deal of time and effort. For example, it would not be unusual for it to take over two years to produce a single typeface in this manner, because there are upwards of 7,000 characters involved in some languages. Embedded bitmap fonts also have the disadvantage of requiring large amounts of memory to store. Because of such limitations, Japanese operating systems tend to ship with very few supported typefaces. In fact, one common operating system of Microsoft Corporation of Redmond, Washington, for Japanese personal computers currently includes only two Japanese typefaces, MS-Gothic and MS-Mincho. Although Kanji characters represent a particularly difficult type to render on LCD display devices, similar low resolution problems are encountered when displaying any characters.

In view of the foregoing, it is apparent that there is a need for improved techniques for displaying images on display devices. It would be desirable for any such techniques to improve resolution in at least one, and more preferably, two-dimensions (i.e., the horizontal and vertical dimensions). It would also be desirable, from the manufacturing standpoint, for at least some new display devices to be manufactured using existing display technology and manufacturing equipment, thereby avoiding the expense that would be associated with developing or obtaining new display device manufacturing equipment.

SUMMARY OF THE INVENTION

The present invention relates to methods and systems for improving the resolution of displayed images in the horizontal and vertical dimensions of LCD or other flat panel display devices that have separately controllable pixel sub-components. One factor that is responsible for at least some of the improved resolution is that the separately controllable pixel sub-components, rather than full pixels, are treated as individual luminous intensity sources. Each pixel sub-component represents a spatially different portion of the image. In order to obtain such results, spatially different sets of one or more samples of the image data are mapped to the individual pixel sub-components, rather than to entire pixels.

Such displaced sampling is responsible for increasing the resolution of the display device in the direction perpendicular to the stripes of the display device. Increased resolution in the orthogonal direction (i.e., the direction parallel to the stripes) is achieved by increasing the pixel sub-component density beyond that of conventional display devices. For instance, each region of the display device that would ordinarily consist of a single pixel with three pixel sub-components is configured to include two or three full pixels, each having three pixel sub-components. The pixel sub-components have heights 1.5 times greater than their widths if the pixel sub-component density is doubled, or are square if the density is tripled. The pixel sub-component density can be increased by other factors, as well, although a factor of two or three has the advantage that the height dimension is no smaller than the width dimension, and existing pixel sub-component manufacturing techniques can be readily adapted to construct such display devices.

Display devices having the foregoing pixel and pixel sub-component configurations can enable images to be displayed with resolutions that are improved both in the vertical and horizontal dimensions compared with conventional rendering processes. The two-dimensional improvement in resolution can be particularly advantageous for displaying complex characters, such as Kanji characters, that rely heavily character features that have fine detail in both the horizontal and vertical dimensions.

Many existing computers do not have the capability of transmitting luminous intensity values in control signals to display devices at a rate great enough to support the increased pixel sub-component densities of the display devices disclosed herein. In order to make use of the available bandwidth of such computers, the image data processing and image rendering processes of the invention also extend to image data compression techniques.

The image data compression processes are adapted to encode the luminous intensity values to be applied to a set of vertically adjacent pixels referred to as a control element of the display device. The control element includes a set of two vertically adjacent pixels when the pixel sub-component density is doubled and a set of three vertically adjacent pixels when the pixel sub-component density is tripled, such that the control element occupies a substantially square portion of the display device.

The luminous intensity values applied to the pixel sub-components in a control element are encoded in a data structure having a length, for example, of 8, 16, or 24 bits. The data structure includes a red luminous intensity value, a green luminous intensity value, a blue luminous intensity value, and a bias value. The red, green, and blue luminous intensity values correspond to the overall or average luminance to be generated in the pixel sub-components of the control element. The bias value indicates the relative luminance between the multiple pixels in the control element. For instance, if the control element includes two vertically adjacent pixels, the bias value indicates whether the luminance is to be biased toward the upper pixel, toward the lower pixel, or to be distributed evenly.

The data compression techniques of the invention allow the control signal to be transmitted to the display device at substantially the same rate as would be experienced if the pixel sub-component density were not increased. In other words, if a particular display system operating on a computer transmits 16 bits of data per square pixel in the absence of increased pixel sub-component density, the compressed control signal for the display device having the increased pixel sub-component density can also use 1.6 bits of data per control element (i.e., square region of the display device). Of course, the cost of the data compression is generally the loss of some resolution compared to the resolution that would be obtained if each pixel were to be independently controlled without data compression.

The invention also extends to display devices that are further adapted to decrease the color artifacts that can be generated from treating each pixel sub-component as a separate luminance source. In one implementation, the position of the red and blue pixel sub-components in a pixel is transposed in alternating adjacent rows. This pixel sub-component configuration breaks; up the vertical stripes of same colored red and blue pixel sub-components that are present in many conventional display devices, thereby diminishing the color fringing effects that can be experienced. In other implementations, successive rows of pixels have red, green, and blue pixel sub-components that are offset by ⅓ or ⅔ the width of the full pixel, so that the stripes are not formed from same-colored pixel sub-components, but are instead formed from alternating red, green, and blue pixel sub-components.

Additional advantages of the invention will be set forth in the description which follows, and in part will be obvious from the description, or may be learned by the practice of the invention. The advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIGS. 5A and 5B illustrate portions of a display device in which the pixel sub-component density in the vertical dimension has been increased by a factor of three.

DETAILED DESCRIPTION OF THE PREFERRED EMBODIMENTS

The present invention relates to systems and methods for increasing the resolution of images displayed on LCD or other display devices having pixels that include separately controllable pixel sub-components. Assuming that the display device has vertical stripes, much of the enhanced resolution in the horizontal dimension is achieved by performing displaced sampling on the image data and mapping the displaced samples to individual pixel sub-components instead of mapping samples to full pixels. The improved resolution in the vertical dimension is achieved by increasing the pixel sub-component density in the vertical dimension. To accommodate the increased number of pixel sub-components, the invention also relates to image data compression techniques whereby sets of vertically adjacent pixels are controlled using a red luminous intensity value, a green luminous intensity value, a blue luminous intensity value, and a bias value. The red, green, and blue luminous intensity values control the overall luminance from the sets of red, green, and blue pixel sub-components, while the bias value indicates if, and to what extent, the luminance is to be shifted to a particular pixel in the set of pixels.

I. Exemplary Computing and Hardware Environments

Embodiments of the present invention may comprise a special purpose or general purpose computer including various computer hardware, as discussed in greater detail below. Embodiments within the scope of the present invention also include computer-readable media for carrying or having computer-executable instructions or data structures stored thereon. Such computer-readable media can be any available media which can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer.

When information is transferred or provided over a network or another communications connection (either hardwired, wireless, or a combination of hardwired or wireless) to a computer, the computer properly views the connection as a computer-readable medium. Thus, any such a connection is properly termed a computer-readable medium. Combinations of the above should also be included within the scope of computer-readable media. Computer-executable instructions comprise, for example, instructions and data which cause a general purpose computer, special purpose computer, or special purpose processing device to perform a certain function or group of functions.

Figure 3:
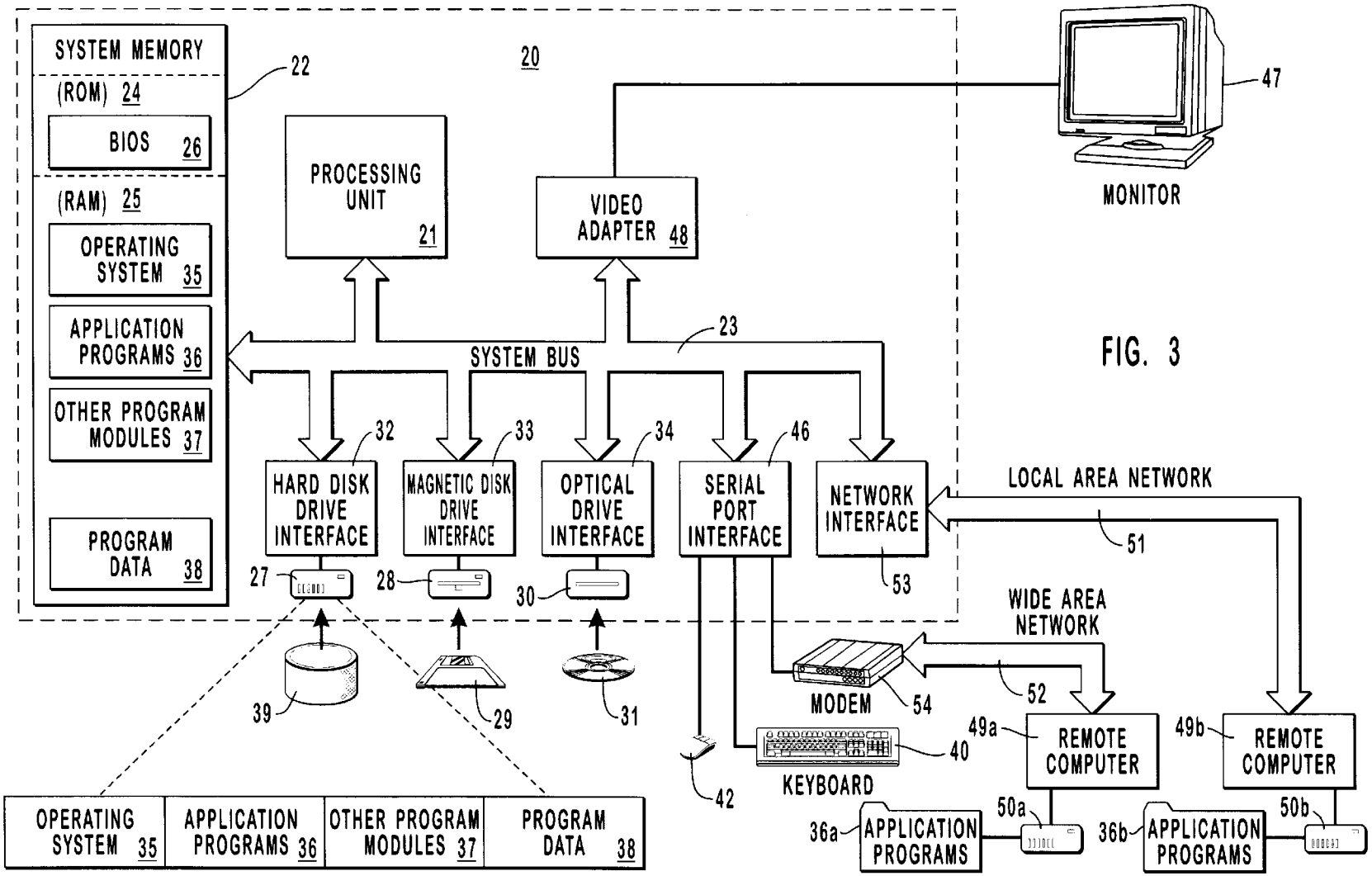
FIG. 3 illustrates an exemplary system that provides a suitable operating environment for embodiments of the present invention.

FIG. 3 and the following discussion are intended to provide a brief, general description of a suitable computing environment in which the invention may be implemented. Although not required, the invention will be described in the general context of computer-executable instructions, such as program modules, being executed by computers in network environments. Generally, program modules include routines, programs, objects, components, data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represent examples of corresponding acts for implementing the functions described in such steps.

Those skilled in the art will appreciate that the invention may be practiced in network computing environments with many types of computer system configurations, including personal computers, hand-held devices, multi-processor systems, microprocessor-based or programmable consumer electronics, network PCs, minicomputers, mainframe computers, and the like. The invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

With reference to FIG. 3, an exemplary system for implementing the invention includes a general purpose computing device in the form of a conventional computer 20, including a processing unit 21, a system memory 22, and a system bus 23 that couples various system components including the system memory 22 to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system (BIOS) 26, containing the basic routines that help transfer information between elements within the computer 20, such as during start-up, may be stored in ROM 24.

The computer 20 may also include a magnetic hard disk drive 27 for reading from and writing to a magnetic hard disk 39, a magnetic disk drive 28 for reading from or writing to a removable magnetic disk 29, and an optical disk drive 30 for reading from or writing to removable optical disk 31 such as a CD-ROM, CD-R, CD-RW or other optical media. The magnetic hard disk drive 27, magnetic disk drive 28, and optical disk drive 30 are connected to the system bus 23 by a hard disk drive interface 32, a magnetic disk drive-interface 33, and an optical drive interface 34, respectively. The drives and their associated computer-readable media provide nonvolatile storage of computer-executable instructions, data structures, program modules and other data for the computer 20. Although the exemplary environment described herein employs a magnetic hard disk 39, a removable magnetic disk 29 and a removable optical disk 31, other types of computer readable media for storing data can be used, including magnetic cassettes, flash memory cards, digital video disks, Bernoulli cartridges, RAMs, ROMs, and the like.

Program code means comprising one or more program modules may be stored on the hard disk 39, magnetic disk 29, optical disk 31, ROM 24 or RAM 25, including an operating system 35, one or more application programs 36, other program modules 37, and program data 38. A user may enter commands and information into the computer 20 through keyboard 40, pointing device 42, or other input devices (not shown), such as a microphone, joy stick, game pad, satellite dish, scanner, or the like. These and other input devices are often connected to the processing unit 21 through a serial port interface 46 coupled to system bus 23. Alternatively, the input devices may be connected by other interfaces, such as a parallel port, a game port or a universal serial bus (USB). A monitor 47 or another display device is also connected to system bus 23 via an interface, such as video adapter 48. In addition to the monitor, personal computers typically include other peripheral output devices (not shown), such as speakers and printers.

The computer 20 may operate in a networked environment using logical connections to one or more remote computers, such as remote computers 49*a* and 49*b*. Remote computers 49*a* and 49*b* may each be another personal computer, a server, a router, a network PC, a peer device or other common network node, and typically includes many or all of the elements described above relative to the computer 20, although only memory storage devices 50*a* and 50*b* and their associated application programs 36*a* and 36*b* have been illustrated in FIG. 2. The logical connections depicted in FIG. 2 include a local area network (LAN) 51 and a wide area network (WAN) 52 that are presented here by way of example and not limitation. Such networking environments are commonplace in office-wide or enterprise-wide computer networks, intranets and the Internet.

When used in a LAN networking environment, the computer 20 is connected to the local network 51 through a network interface or adapter 53. When used in a WAN networking environment, the computer 20 may include a modem 54, a wireless link, or other means for establishing communications over the wide area network 52, such as the Internet. The modem 54, which may be internal or external, is connected to the system bus 23 via the serial port interface 46. In a networked environment, program modules depicted relative to the computer 20, or portions thereof, may be stored in the remote memory storage device. It will be appreciated that the network connections shown are exemplary and other means of establishing communications over wide area network 52 may be used.

II. LCD Display Devices With Increased Pixel Sub-Component Densities

Computer display devices are two-dimensional devices. Since display devices are normally oriented in a vertical fashion, for convenience, the first and second dimensions of a display device are commonly referred as vertical (y) and horizontal (x) dimensions, respectively. By rotating the physical display device, the horizontal and vertical dimensions can be interchanged. For purposes of explanation, the methods and apparatus of the present invention will be explained in terms of vertical and horizontal dimensions. However, it is to be understood that the described exemplary display devices can be rotated to achieve the described improvement in resolution in the vertical direction in the horizontal direction, and the described improvement in resolution in the horizontal direction, in the vertical direction.

As discussed above, pixel elements commonly include red, green and blue pixel sub-components. The luminous intensity of each pixel sub-component may be separately controlled by selecting a luminous intensity control value associated with the particular pixel sub-component. In most known devices, each R, G and B pixel sub-component is rectangular in shape and is three times taller than it is wide. The three rectangular pixel sub-components form a square pixel.

In accordance with one embodiment of the present invention, R, G, B luminous intensity values are independently controlled to represent different portions of an image. This provides an increase in the horizontal spatial resolution of up to three times over those of conventional rendering techniques that use the entire pixel to represent a single portion of an image. Further details relating to image data processing and image rendering techniques that utilize displace sampling and mapping of spatially different sets of one or more samples to individual pixel sub-components, and which can be adapted for use with the present invention are disclosed in U.S. patent application Ser. No. 09/168,014, filed Oct. 7, 1998, entitled "Methods and Apparatus for Performing Image Rendering and Rasterization Operations," which is incorporated herein by reference. This patent application also discloses other facets of the image data processing that can be used with the invention, including image scaling, hinting, filtering, and scan conversion operations.

Figure 1:
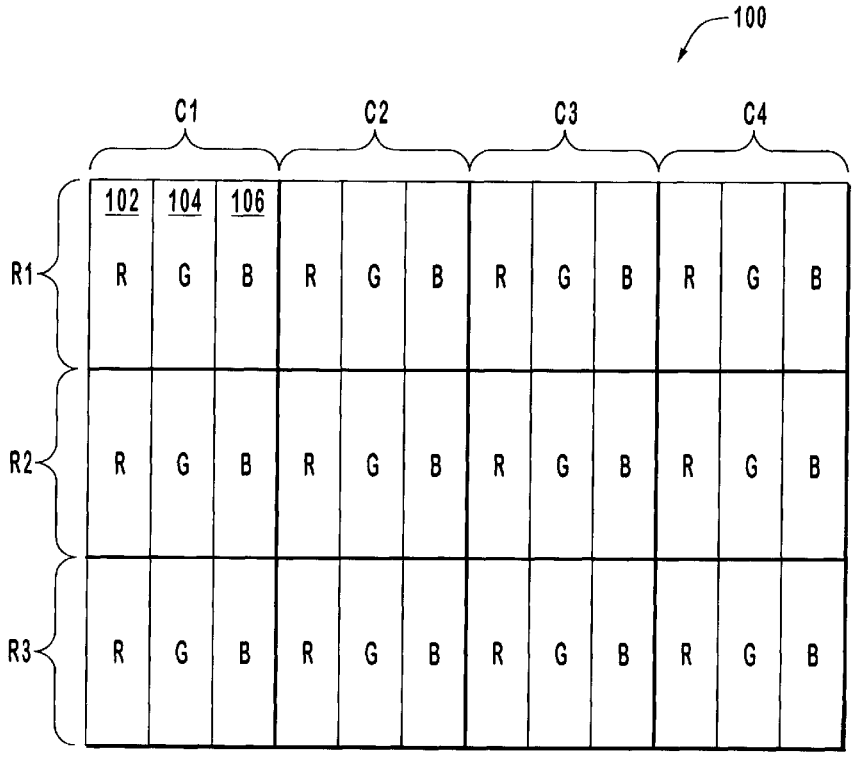
FIG. 1 illustrates a portion of a conventional liquid crystal display device.
Figure 2:
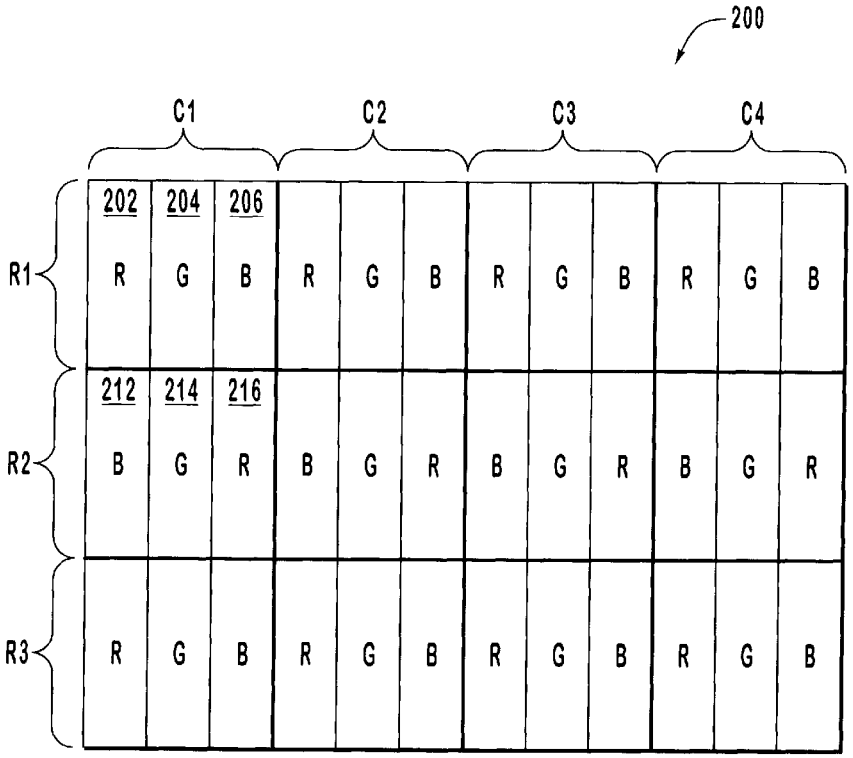
FIG. 2 illustrates a display device in which the position of the red and blue pixel sub-components is transposed on alternating rows of the display device according to one embodiment of the present invention.

Unfortunately, in cases where the R, G, B elements are arranged in vertical stripes as in the case of the conventional LCD device illustrated in FIG. 1, treating the pixel sub-components as separate luminous intensity sources can result in some color distortions. For example, undesired red and/or green vertical stripes or fringes may be visible in a displayed image. In one embodiment of the present invention, to decrease the visibility of color artifacts introduced by treating pixel sub-components as independent luminous sources, the common RGB striped display pattern is replaced with a pattern that transposes the position of red and blue pixel sub-components in alternating rows, as illustrated in FIG. 2. Row R1 of display device 200 includes a series of pixel sub-components having an (R, G, B, R, G, B, . . . ) pattern. In contrast, row R2 includes a series of pixel sub-components having an (B, G, R, B, G, R, . . . ) pattern. Stated another way, the vertically adjacent pixel sub-components 202 and 212 have different colors (red and blue), the vertically adjacent pixel sub-components 204 and 214 have the same green color, and the vertically adjacent pixel sub-components 206 and 216 have different colors (blue and red).

Such pixel sub-component configurations can reduce the effect of color artifacts by eliminating the contiguous red and blue vertical pixel sub-component stripes. It is these contiguous vertical color strips that can produce distracting red and blue fringing effects in an image. Rather than having vertical stripes of same-colored red and blue pixel sub-components, LCD device 200 has vertical stripes of alternating red and blue pixel sub-components.

The foregoing techniques of treating pixel sub-components as independent luminous sources can result in a significant increase in spatial resolution in the dimension perpendicular to the direction of the stripes. When the display device has vertical stripes, this method of increasing image resolution is particularly useful for rendering Latin-based characters or other characters that rely more heavily on vertical character features than horizontal character features. As noted above, however, Kanji characters generally depend as heavily on horizontal character features as they do on vertical features. Accordingly, to increase the legibility of Kanji characters, it is important to increase vertical as well as horizontal resolution.

Figure 4A:
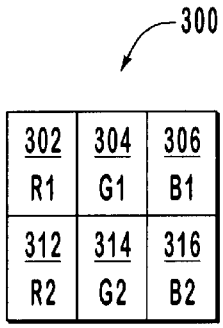
FIGS. 4A and 4B depict portions of a display device having a pixel sub-component density in the vertical dimension that has been increased by a factor of two according to one embodiment of the invention.
Figure 4B:
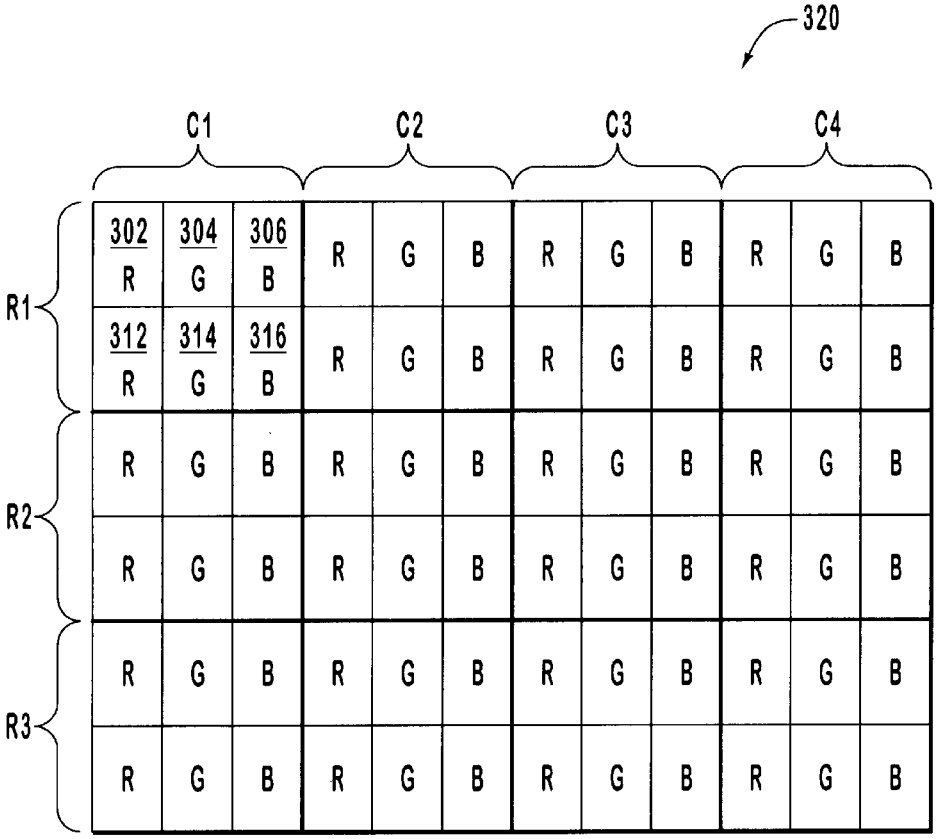

In various embodiments of the present invention, resolution is increased in the vertical dimension by increasing the number of pixel sub-components in this dimension. For example, the number of pixel sub-components per unit distance in the direction parallel to the stripes can be doubled with respect to the conventional display device illustrated in FIG. 1. One example of such a display device is illustrated in FIGS. 4A and 4B. The portion of LCD display device 320 illustrated in FIG. 4B includes rows R1–R3 and columns C1–C4. Rows R1–R3 represent scanlines of the display device 320 that are oriented perpendicularly to the vertical striping. In contrast, display devices having horizontal striping have vertical scanlines. Each region of LCD device 320 that would correspond to a single full pixel with three pixel sub-components in a conventional display device instead represents two pixels containing a total of six pixel sub-components. For instance, FIG. 4A illustrates one such region 300 of display device 320, which includes separately controllable pixel sub-components R1, G1, B1, R2, G2, and B2, indicated by reference numbers 302, 304, 306, 312, 314, and 316, respectively.

The pixel and pixel sub-component configuration of FIGS. 4A and 4B results in pixel sub-components that are approximately 1.5 times taller than they are wide. In other words, the aspect ratio of the pixel sub-components is approximately 1.5:1. It is noted that the aspect ratios can describe the size and relative positioning of the pixel sub-components regardless of whether the display device has vertical or horizontal stripes. The decreased aspect ratio of the pixel sub-components of FIGS. 4A and 4B has the effect of increasing the resolution in the vertical direction. The apparent factor by which the resolution is increased depends largely on the manner in which the pixel sub-components 302, 304, 306, 312, 314, and 316 are controlled, as will be described in greater detail below. When the pixel and pixel sub-component configuration of FIGS. 4A and 4B is combined with the above-discussed technique of increasing the perceived resolution in the horizontal dimension, characters with increased vertical resolution and increased horizontal resolution can be displayed.

Figure 4C:
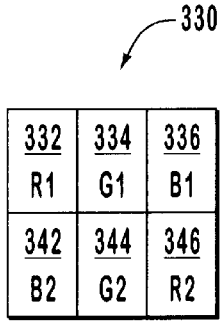
FIGS. 4C and 4D depict portions of a display device having a pixel sub-component density in the vertical dimension that has been increased by a factor of two and that also has the position of the red and blue pixel sub-components transposed on alternating rows according to one embodiment of the invention.
Figure 4D:
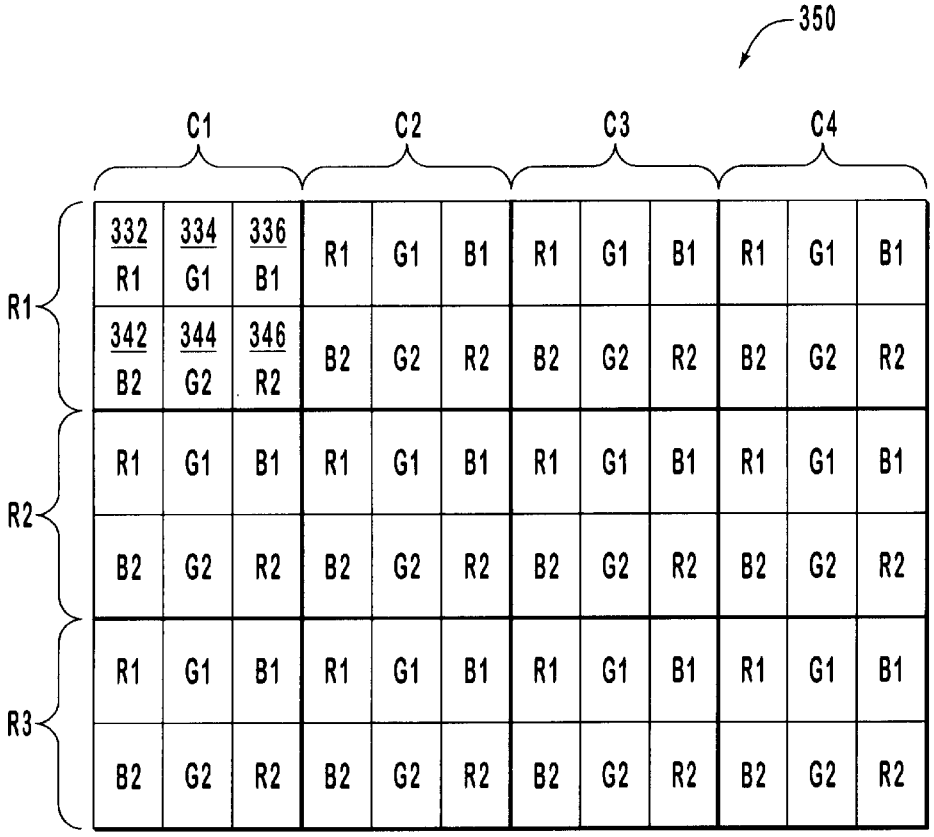

FIGS. 4C and 4D depict a portion of an LCD device 350 that has pixel sub-components that are approximately 1.5 times taller than they are wide, as in the example of FIGS. 4A and 4B, in combination with transposing the position of the red and green pixel sub-components on alternating rows as has been described in reference to FIG. 3. Each region of display device 350 of FIG. 4D that would correspond to a single full pixel in conventional LCD devices instead represents two pixels that include a total of six pixel sub-components. For instance, region 330 of FIG. 4C includes pixel sub-components R1, G1, B1, B2, G2, R2 indicated by reference numbers 332, 334, 336, 342, 344, and 346, respectively. The embodiment of FIGS. 4C and 4D can generate increased resolution in the vertical and horizontal directions, as well as reducing some of the color artifacts that could otherwise be experienced.

In other embodiments, resolution is increased by tripling the number of pixel sub-components in the vertical dimension. For example, in FIG. 5B, each region of display device 450 that would correspond to a single full pixel in conventional LCD devices instead represents three pixels that include a total of nine pixel sub-components. For instance, region 400 of FIG. 5A includes pixel sub-components R1, G1, B1, R2, G2, B2, R3, G3, B3 indicated by reference numbers 402, 404, 406, 408, 410, 412, 414, 416, and 418, respectively. The pixel and pixel sub-component configuration of FIGS. 5A and 5B results in pixel sub-components that are square or approximately square, or have aspect ratios of approximately 1:1.

The doubling or tripling of the resolution in the vertical dimension can be implemented using existing display device manufacturing equipment since it does not require a finer gradation between pixel sub-components than is already found in the horizontal dimension.

Specific examples of increasing the number of pixel sub-components in the direction of the striping of the display device by factors of two and three have been presented. Increasing the pixel sub-component density by factors of two and three has certain advantages, such as maintaining generally square regions of the display device and preserving pixel sub-component heights that are at least as great as the widths, which enables previously-known manufacturing techniques to be adapted for constructing these display devices. However, the invention also extends to increasing the pixel sub-component density by other factors so as to improve the resolution in the direction parallel to the stripes.

Each set or triad of RGB pixel sub-components produced by increasing the number of pixel sub-components in the direction parallel to the striping can be treated as a separate pixel. Such treatment, in the case where the pixel sub-component density is increased by a factor of two, results in non-square pixels that are half as tall as they are wide. In order to fully use all of the pixels, the display software generates and transmits a signal containing twice as many luminous intensity values associated with pixel sub-components than would be needed if the pixel sub-component density had not been increased by a factor of two. Similarly, when the pixel sub-component density is increased by a factor of three, the number of luminous intensity values is also tripled if the pixel sub-components are to be fully and independently utilized to represent different portions of the image data.

III. Image Data Compression

The large number of luminous intensity values that are to be transmitted in the control signal for display devices, such as those illustrated in FIGS. 4A–5B can present bandwidth problems in some systems. That is, some systems may not be capable of generating and transmitting such a large number of independent luminous intensity values during the time available for each update of the display device. In addition, as discussed above, many existing image processing applications assume that pixels are square. There may be some inefficiencies or complexities associated with using non-square pixels with such applications.

In order to compensate for the limited bandwidth capabilities of many existing computer systems, embodiments of the present invention relate to compressing the luminous intensity values associated with the pixel sub-components of display devices having increased pixel sub-component densities. The data compression sacrifices some resolution in exchange for reducing the data transmission requirements to render images.

In systems capable of processing and transmitting double or triple the number of video control signals that would otherwise be needed in the absence of increased pixel sub-component densities, each set, or triad, of RGB pixel sub-components can be treated as an independent pixel without using the data compression techniques disclosed herein. However, when image data compression can be beneficial, sets of pixels are grouped together for control purposes.

For example, in FIGS. 4A–4D, where the pixel sub-component density is doubled in the vertical dimension, two sets of vertically adjacent RGB pixel sub-components can be grouped together to form a pair of adjacent pixels that is referred to herein as a "control element". For example, region 300 of FIG. 4A and region 400 of FIG. 5A are examples of control elements. In such an embodiment, each pair of pixels occupies a generally square region of the display device and corresponds in size to a single pixel of a conventional display device. Although the control element can consist of adjacent pixels, control elements can, in general, consist of two or more pixels, regardless of whether the pixels are adjacent one to another.

For data compression purposes, in accordance with one embodiment of the present invention, the luminance generated by the pixel sub-components in each control element is controlled using a single red luminous intensity value, a single green luminous intensity value, a single blue luminous intensity value, and a bias value. The bias value indicates how the light energy specified by the R, G and B luminous intensity values should be distributed or differentially applied between the upper pixel and the lower pixel of the control element. The bias value indicates, for example, whether the luminance should be evenly distributed between the upper and lower pixels, or whether it should be weighted by a specified factor to the upper or lower pixel.

Opportunity for bias depends on the specified luminous intensity of each color component. Accordingly, in the case where the different color components are assigned different luminous intensity values, the opportunity for bias will be different for each of the R, G and B components. Medium gray offers a large opportunity for bias, since the R, G and B luminous intensity values are each at their midrange point. This allows for one pixel, sub-component, in a control element that includes a pair of pixels, each having R, G and B pixel sub-components, to be turned fully on and the corresponding pixel sub-components in the other pixel in the control element to be turned fully off, if desired, without affecting the overall energy output.

In order to optimize the use of the bandwidth available for transmitting luminous intensity values to the display device, the number of bits included in the red, green, and blue luminous intensity values and the bias value can be selected in view of empirical observations relating to the perception of colors by humans. In general, most humans can perceive green light far better than red or blue light. Studies have shown that, in general, of the total perceived luminous intensity of a light source that outputs red, green, and blue light of the same luminous intensity, approximately 60% of the perceived luminous intensity is associated with the green light, 30% with the red light, and 10% with the blue light. For this reason, humans tend to be able to distinguish differences in green luminous intensity values far better than differences in red or blue luminous intensity values.

In many conventional computer systems, the luminous intensity of the R, G, and B pixel sub-components is controlled using a control signal that includes 8, 16 or 24 bits per pixel. Multiples of eight bits are frequently used in control signals to efficiently use the data capacity of data words used to transmit such signals. Conventional systems that use a total of eight bits to specify the luminous intensity values of red, green and blue pixel sub-components of a single pixel normally allocate three bits for specifying the red luminous intensity value, three bits for specifying the green luminous intensity value and two bits for specifying the blue luminous intensity value. Conventional systems that use a total of sixteen bits to specify the luminous intensity values of red, green and blue pixel sub-components normally allocate five bits for specifying the red luminous intensity value, six bits for specifying the green luminous intensity value and five bits for specifying the blue luminous intensity value.

To support the display of an extremely large number of different colors, some conventional computer systems, including many personal computers, use twenty-four bits to specify the luminous intensity values of red, green and blue pixel sub-components that form a single pixel. In such systems, eight of the twenty-four available bits are usually dedicated to specifying the luminous intensity value of each of the red, green and blue pixel sub-components.

The allocation of bits commonly used to specify the luminous intensity values of pixel sub-components in conventional systems is shown in Table 1:

TABLE 1

| Total bits per pixel | Bits per R component | Bits per G component | Bits per B component |
|---|---|---|---|
| 8 | 3 | 3 | 2 |
| 16 | 5 | 6 | 5 |
| 24 | 8 | 8 | 8 |

By using fewer bits than is commonly used in the examples presented in Table 1 to represent the set of RGB luminous intensity values, and dedicating the unused bits for use as the bias value, a display device having an increased pixel sub-component density can be controlled using control signals that require no more data to transmit. Of course, the cost of performing such data compression is often the loss of some spatial or color resolution in the rendered image.

In the above-described manner, a display device having two pixels in each control element can be controlled using an 8-bit signal where two bits are used for the R luminous intensity value, two bits for the G luminous intensity value, two bits for the B luminous intensity value, and two bits for the bias value. In the case where 16 bits are available per control element, four bits can be used to specify the red luminous intensity value, six to specify the green luminous intensity value, four to specify the blue luminous intensity value, and two bits to specify the bias value. In the case of a 24-bit interface, eight bits can be used to specify the red luminous intensity value, eight to specify the green luminous intensity value, six to specify the blue luminous intensity value, and two bits to specify the bias value.

These ratios favor reallocation of blue and/or red luminous intensity control bits for use as bias value bits, since humans are less sensitive to different intensity levels of these colors than to different green intensity levels. However, alternative allocations of control bits to luminous intensity and bias values are also possible. For example, other embodiments of the invention use three bits to support a wider range of luminous intensity bias values. Still other embodiments use six bias bits so that the biasing of each pair of red, green and blue pixel sub-components can be independently controlled. In one 6-bit bias control signal embodiment, each pair of bias bits represents a separate red, green and blue bias signal.

A two-bit bias value can indicate whether or not a bias is to be applied, and whether the upper or lower RGB set should be responsible for outputting the majority of the light energy from the pixel element. For example, in one exemplary embodiment, a bias control signal value 00 indicates that the luminous energy should be spread evenly between the upper and lower pixels, a bias control signal value 10 indicates that the luminous energy should be biased downward so that the lower pixel outputs more light than the upper pixel; and a bias control signal value of 01 indicates that the luminous energy should be biased upward so that the upper pixel outputs more light than the lower pixel.

The luminous intensity control techniques of the present invention, which involve the use of separate R, G, B luminous intensity values, in conjunction with a bias value, can be used to control pixel elements comprising three or more sets of R, G and B luminous intensity values. Such a control method is particularly well suited to applications where the pixel sub-component density have been tripled in the vertical dimension so that individual RGB pixel sub-components are square and have vertical and horizontal dimensions equal to ⅓ the width of a pixel. In such embodiments, three vertically adjacent pixels can be grouped together to form a singe square control element.

In one such embodiment, where each control element includes three sets of RGB pixel sub-components, a 3-bit bias control signal is used. The 3-bit bias signal supports a large enough number of different luminous intensity energy distributions that reasonable use of the available vertical resolution, corresponding to the three vertically adjacent pixels, can be obtained.

The values of the bias bits can be derived by sampling image data such that the vertical distance between vertically adjacent samples is equal to the height of the pixel sub-components. To select the bias bits, first the two (or three) desired RGB luminous intensity values are averaged together, component-wise, and each color is quantized to the appropriate level for the display device. This average of the RGB luminous intensity values corresponds to the desired overall luminance for the control element. Next, the overall luminance that would be generated in the control element for each possible bias bit setting is computed and compared to the averaged desired output for the control element. These control element outputs are patterns consisting of two by three emitters or three by three emitters, as disclosed herein. In one embodiment, the bias bits are chosen to minimize the square of the Euclidean distance between the averaged desired control element output and the actual control element output. Other error metrics can also be used, including those that will be obvious to those skilled in the art upon learning of the invention disclosed herein.

In one exemplary embodiment, the results of the resolution-enhancing filtering can be quantized as one 8-bit value per control element. In this embodiment, the vertical pixel sub-component density (and the corresponding rate of sampling) is increased by a factor of two. Thus, two 8-bit filtered RGB values are to be converted into one 8-bit signal including the RGB luminous intensity values and the bias value. This conversion can be accomplished via a lookup table, using techniques that will be understood by those skilled in the art, upon learning of the invention disclosed herein. If the lookup table is accomplished in software by the operating system, it does not require a large amount of computation. Alternatively, the lookup table can be implemented in hardware in a video card.

IV. Examples of Characters

Figure 6:
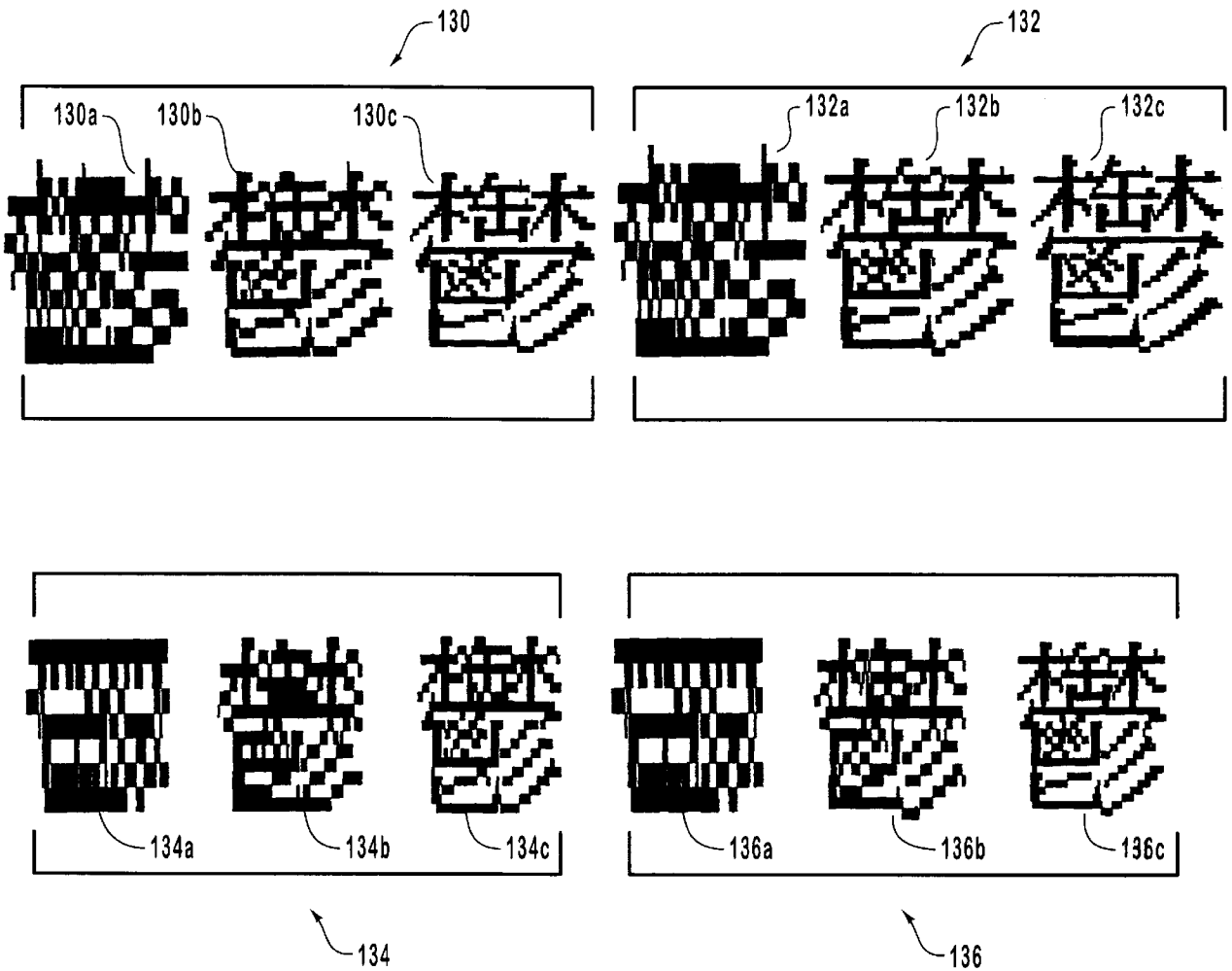
FIGS. 6 and 7 qualitatively illustrate improvements in readability of various Kanji characters that can be obtained by increasing the pixel sub-component density in the vertical dimension.
Figure 7:
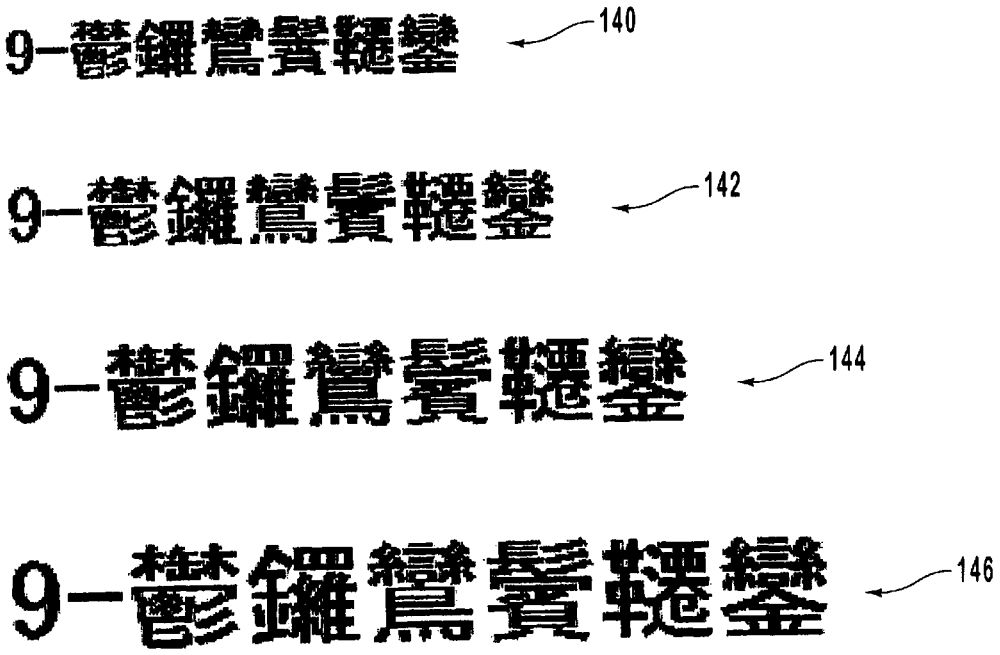

FIGS. 6 and 7 qualitatively illustrate the increased resolution that can often be obtained by displaying images according to the invention. The characters of FIGS. 6 and 7 are those that can be generated by independently controlling each pixel rather than using the data compression techniques of the invention, with the bias values. The characters illustrated in FIGS. 6 and 7 are presented by way of example, and not by limitation. The results of any particular rendering process will depend on many factors, including the size of the pixel sub-components, the sampling and filtering processes used, etc.

FIG. 6 illustrates various representations of the Japanese character "Utsu," which is reputed as being one of the most complex Kanji characters. The characters of FIG. 7 illustrate how an outline-only rendered bitmap may be rendered at different font sizes and at different pixel sub-component densities, both in the vertical and horizontal dimensions.

Set of characters 130 is displayed with 9-point type and corresponds to an LCD display device having 88 dpi (i.e., 88 full pixels per inch). Character 130*a* is rendered using a display device with pixel sub-components that are three times as tall as they are wide or, in other words, with no increased pixel sub-component density. Character 130*b* is displayed using the same display device, but with an increase in the pixel sub-component density by a factor of two. Character 130*c* is displayed with an increase in the pixel sub-component density by a factor of three compared to that of character 130*a*.

Set of characters 132 is displayed with 9-point type and corresponds to an LCD display device having 106 dpi. Character 132*a* is rendered using a display device with pixel sub-components that are three times as tall as they are wide. Character 132*b* is displayed using the same display device, but with an increase in the pixel sub-component density by a factor of two. Character 132*c* is displayed with an increase in the pixel sub-component density by a factor of three compared to that of character 132*a*.

Set of characters 134 is displayed with 6-point type and corresponds to an LCD display device having 88 dpi. Character 134*a* is rendered using a display device with pixel sub-components that are three times as tall as they are wide. Character 134*b* is displayed using the same display device, but with an increase in the pixel sub-component density by a factor of two. Character 134*c* is displayed with an increase in the pixel sub-component density by a factor of three compared to that of character 134*a*.

Set of characters 136 is displayed with 6-point type and corresponds to an LCD display device having 106 dpi. Character 136*a* is rendered using a display device with pixel sub-components that are three times as tall as they are wide. Character 136*b* is displayed using the same display device, but with an increase in the pixel sub-component density by a factor of two. Character 136*c* is displayed with an increase in the pixel sub-component density by a factor of three compared to that of character 136*a*.

FIG. 7 illustrates various Kanji characters as they can appear when displayed according to the invention. Row 140 includes characters that correspond to an LCD display device having 88 dpi and where the conventional pixel sub-component density has been increased by a factor of two. Row 142 includes characters that correspond to an LCD display device having 106 dpi and where the conventional pixel sub-component density has been increased by a factor of two. Row 144 represents the characters of row 140 having been displayed with a pixel sub-component density increased by a factor of three, rather than two. Similarly, row 146 represents the characters of row 142 having been displayed with a pixel sub-component density increased by a factor of three, rather than two.

As can be seen from these examples of rendered characters, the improvement in readability and resolution can be dramatic when the characters are complex and rely heavily on horizontal features.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In a computer system having a processor and a display device, the display device having a plurality of pixels each having a plurality of pixel sub-components of different colors, and wherein each pixel sub-component has an aspect ratio that describes size and relative positioning of the pixel sub-components regardless of whether the display device has vertical or horizontal stripes formed by the pixel sub-components, a method of displaying an image on the display device with increased resolution in both the horizontal and vertical dimensions, the method comprising the steps for:

changing the aspect ratio of the pixel sub-components in order to increase the density of the sub-components of the display device;

mapping samples of information representing an image to individual pixel sub-components of a pixel as opposed to mapping each of the samples to an entire pixel, each pixel sub-component having mapped thereto at least one spatially different sample;

generating a separate luminous intensity value for each pixel sub-component as opposed to each full pixel, the separate luminous intensity value for each sub-component being based on the at least one spatially different sample mapped thereto; and displaying the image using the separate luminous intensity values of each sub-component, resulting in each of the pixel sub-components of the pixel, rather than entire pixels, representing displayed portions of the image.

2. A method as recited in claim 1, wherein the separate luminous intensity values comprise:

a single red luminous intensity value;

a single green luminous intensity value; and a single blue luminous intensity value.

3. A method as recited in claim 1, wherein the display device is comprised of a plurality of control elements, each of which occupies a substantially square region of the display device and consists of two adjacent pixels, each having three pixel sub-components.

4. A computer system for displaying images with increased resolution, comprising:

a processing unit;

a display device capable of being controlled by the processing unit, the display device having a plurality of pixels each having a plurality of separately controllable pixel sub-components of different colors, and wherein each pixel sub-component has an aspect ratio that describes size and relative positioning of the pixel sub-components regardless of whether the display device has vertical or horizontal stripes formed by the pixel sub-components, and wherein the aspect ratio of the pixel sub-components is changed in order to increase the density of the sub-components of the display device; and a computer-readable medium carrying computer-executable instructions for causing an image to be displayed on the display device, the computer-executable instructions, when executed by the processing unit, performing the steps for:

mapping samples of information representing an image to individual pixel sub-components of a pixel as opposed to mapping each of the samples to an entire pixel, each pixel sub-component having mapped thereto at least one spatially different sample;

generating a separate luminous intensity value for each pixel sub-component as opposed to each full pixel, the separate luminous intensity value for each sub-component being based on the at least one spatially different sample mapped thereto; and displaying the image using the separate luminous intensity values of each sub-component, resulting in each of the pixel sub-components of the pixel, rather than entire pixels, representing displayed portions of the image.

5. A computer system as recited in claim 4, wherein the plurality of separately controllable pixel sub-components includes a red pixel sub-component, a green pixel sub-component, and a blue pixel sub-component, the positions of the red pixel sub-components and the blue pixel sub-components being transposed within the pixels in alternating rows of pixels on the display device.

6. A computer system as recited in claim 4, wherein the pixel sub-components have aspect ratios of approximately 1.5:1.

7. A computer system as recited in claim 4, wherein the pixel sub-components have aspect ratios of approximately 1:1.

8. A computer system as recited in claim 4, wherein the display device is a liquid crystal display device.

9. A display device for displaying images with increased resolution, comprising:

a plurality of pixels, each pixel having a plurality of separately controllable pixel sub-components, including:

all only one red pixel sub-component;

only one green pixel sub-component; and only one blue pixel sub-component;

wherein the plurality of pixels are aligned in scanlines on the display device that are either rows or columns, and wherein the position of the red pixel sub-components and the blue pixel sub-component in the pixels is either transposed or offset within the pixels on alternating scanlines, and wherein none of the red pixel sub-component, the green pixel sub-component, and the blue pixel sub-component for any given pixel of the plurality of pixels are shared by any other pixel of the plurality of pixels.

10. A display device as recited in claim 9, wherein the scanlines are rows and the pixels and pixel sub-components are arranged on the display device to form vertical stripes of same-colored green pixel sub-components and vertical stripes of alternating red pixel sub-components and blue pixel sub-components.

11. A display device as recited in claim 9, wherein the pixel sub-components have aspect ratios of approximately 3:1 such that the pixels have aspect ratios of approximately 1:1.

12. A display device as recited in claim 9, wherein the pixel sub-components have aspect ratios of approximately 1.5:1 such that two adjacent pixels occupy a region of the display device having an aspect ratio of approximately 1:1.

13. A display device as recited in claim 9, wherein the pixel sub-components have aspect ratios of approximately 1:1 such that three adjacent pixels occupy a region of the display device having an aspect ratio of approximately 1:1.

14. In a computer system having a processor and a display device, the display device having a plurality of pixels arranged in rows and each having a plurality of pixel sub-components of different colors, a method of displaying an image on the display device with increased resolution and with diminished color fringing effects, the method comprising the steps for:

either transposing or offsetting the pixel sub-components of each pair of adjacent rows in order to break up the vertical stripes that would otherwise be formed by sub-components of the same color;

mapping samples of information representing an image to individual pixel sub-components of a pixel as opposed to mapping each of the samples to an entire pixel, each pixel sub-component having mapped thereto at least one spatially different sample;

generating a separate luminous intensity value for each pixel sub-component as opposed to each full pixel, the separate luminous intensity value for each sub-component being based on the at least one spatially different sample mapped thereto; and displaying the image using the separate luminous intensity values of each sub-component, resulting in each of the pixel sub-components of the pixel, rather than entire pixels, representing displayed portions of the image.

15. A method as recited in claim 14, further comprising a step for compressing the separate luminous intensity values to generate a control signal used to control a control element of the display device including at least two pixels, the control signal including at least:

a single red pixel sub-component;

a single green pixel sub-component;

a single blue pixel sub-component; and a bias value indicating whether, and to what extent, if any, the luminous intensity values are to be differentially applied to a particular one of the at least two pixels.

16. A method as recited in claim 15, wherein the pixel sub-components have aspect ratios of approximately 1.5:1 such that the control element occupies a substantially square region of the display device and consists of two adjacent pixel sub-components.

17. A method as recited in claim 15, wherein the pixel sub-components have aspect ratios of approximately 1:1 such that the control element occupies a substantially square region of the display device and consists of three adjacent pixel sub-components.

* * * * *